United States Patent [19]

Zils

[11] Patent Number: 4,462,281

[45] Date of Patent: Jul. 31, 1984

[54] BOLT HOLDING WRENCH

[75] Inventor: James A. Zils, Parma, Ohio

[73] Assignee: Russell, Burdsall & Ward Corporation, Cleveland, Ohio

[21] Appl. No.: 435,716

[22] Filed: Oct. 21, 1982

[51] Int. Cl.[3] ..... B25B 17/00

[52] U.S. Cl. ..... 81/56

[58] Field of Search ..... 81/56, 55

[56] References Cited

U.S. PATENT DOCUMENTS

| | | | |
|---|---|---|---|
| 2,882,773 | 4/1959 | Wing | 81/56 |
| 3,323,394 | 6/1967 | Bangerter et al. | 81/52.3 |
| 3,789,705 | 2/1974 | Naslund | 81/13 |
| 4,289,049 | 9/1981 | Rebish | 81/56 |

*Primary Examiner*—Frederick R. Schmidt
*Assistant Examiner*—J. T. Zatarga
*Attorney, Agent, or Firm*—Pearne, Gordon, Sessions, McCoy, Granger & Tilberry

[57] ABSTRACT

A customized, substantially standard power wrench is disclosed which has been modified to provide bolt holding capability. The housing is machined to provide a cylindrical opening and an internal, shallow, oval-shaped recess. An adapter assembly includes an adapter ring projecting through the housing opening formed with an oval-shaped flange axially positioning the adapter ring and preventing relative rotation between the adapter ring and the main housing of the wrench. A bit rod extends longitudinally through the wrench to the drive end and is biased toward the drive end by a spring located in a spring housing threaded onto the adapter ring. The simple mounting of the bit rod and adapter ring minimizes the conversion cost of the tool to render it capable of bolt holding operation.

14 Claims, 3 Drawing Figures

BOLT HOLDING WRENCH

BACKGROUND OF THE INVENTION

This invention relates generally to power wrenches, such as impact wrenches or the like, and more particularly to a novel and improved modification of substantially standard power wrenches to provide them with bolt holding capacities.

Prior Art

Bolt holding wrenches which operate to hold a bolt, at the end remote from its head, against rotation while the nut is rotated relative to the bolt are known. Such tools are desirable in many instances, since they permit the entire wrenching operation to be performed from one end and do not require the holding of the head end of the bolt while the nut is rotated. Examples of such wrenches are illustrated in U.S. Pat. Nos. 2,882,773; 3,323,394; 3,789,705; and 4,289,049. The latter of such patents is assigned to the assignee of this invention, and is incorporated herein by reference.

Generally, such wrenches have been custom-manufactured, and because of the relatively low volume of sales of these specialized types of wrenches, they have been relatively expensive.

SUMMARY OF THE INVENTION

In accordance with the present invention, a novel and improved structure is provided for modifying a substantially standard power wrench to convert it to a bolt holding wrench. Such modification may be economically made so that the cost of customizing the wrench is not excessive. Therefore, the economies of producing a standard, high production wrench are, to a large extent, retained even though the modified or customized wrench is not a high production item.

In the illustrated embodiment, the end of the standard wrench housing is machined to provide a cylindrical opening and an internal recess of counterbore proportioned to receive a radially extending flange on an adapter member. The adapter member is shaped to closely fit into such opening and recess. The remainder of the adapter housing assembly is connected to and supported on the adapter member or ring.

A non-circular bolt holding bit rod (preferably hexagonal in cross section) extends through a mating non-circular opening in the adapter housing assembly, and through the power wrench proper to the drive end thereof, where it can engage a bolt and hold it against rotation as a nut or the like is tightened or loosened. A spring axially biases the bit rod toward an extended position, but allows it to retract as the nut is tightened.

The interfitting flange and counterbore operate to axially locate the adapter housing assembly in at least one direction and radial location is provided by the bore in the wrench housing and mating cylindrical portion of the adapter ring extending therethrough.

In the illustrated embodiment, the recess is a non-circular oval and the flange is a mating oval, so that the adapter ring, and in turn the adapter housing assembly, is locked against rotation.

With this invention, a relatively low cost machining operation on the housing of a standard power wrench adapts it to receive the adapter housing assembly. The only other modification normally required to customize the wrench for bolt holding capacity is to provide a tubular socket drive member and, in some instances, a tubular motor, so that the bit rod can extend lengthwise of the wrench proper to a position where it can engage the bolt and hold it against rotation as the wrench is operated.

These and other aspects of this invention are illustrated in the accompanying drawings, and more fully described in the following specification:

DETAILED DESCRIPTION OF THE DRAWINGS

Figure 1:
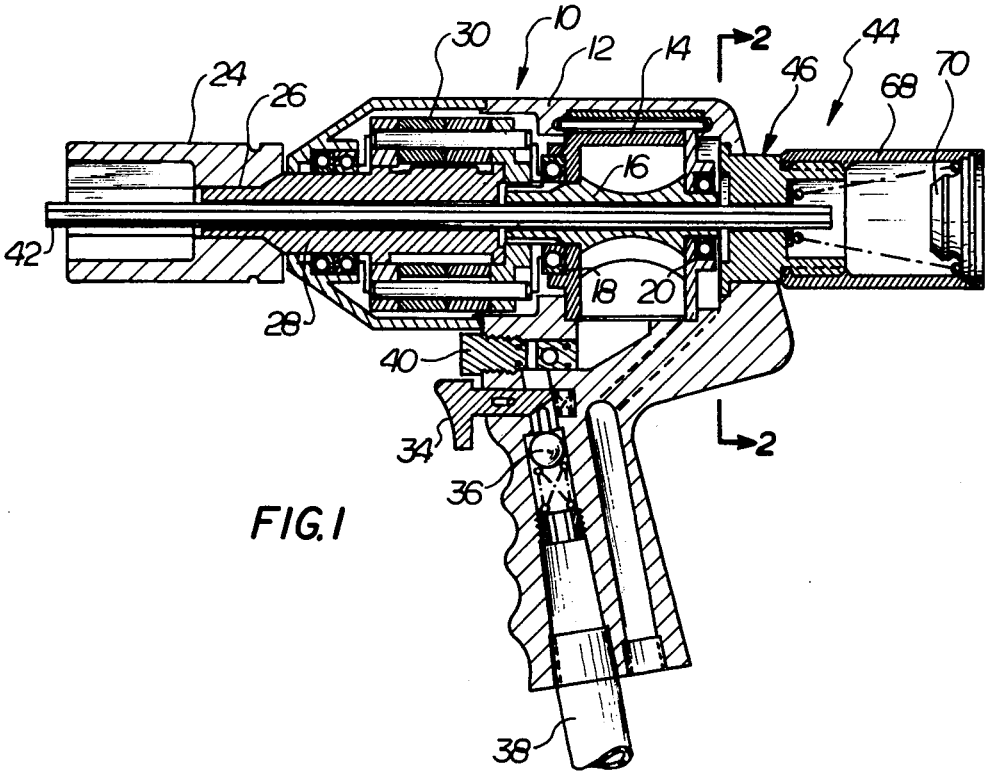
FIG. 1 is a longitudinal cross section of a bolt holding power wrench incoporating this invention.

FIG. 1 illustrates the invention as applied to a typical pneumatic impact wrench of a type known to those skilled in the art. Such tool includes a rigid metal housing 12 in which a fluid motor 14 is mounted. The motor 14 includes a rotor or drive member 16 which is journaled and supported by bearings 18 and 20. During operation of the power tool 10, the motor 14 is operated to rotate a socket 24 about its longitudinal central axis to tighten or loosen a connection between internally and externally threaded fastener elements, such as a nut and bolt. The socket 24 is connected with an axially outer end portion 26 of a tubular rotatable socket drive member 28, which is connected with the motor rotor 16 by a hammer and anvil assembly 30.

To operate the power tool 10, a trigger 34 is actuated to open a valve 36 to admit air under pressure from a conduit 38 to the motor 14. The high pressure air drives the motor in a manner known to those skilled in the art and, through its connection of the hammer and anvil assembly 30, rotates the socket to, for example, tighten a nut on the bolt. A directional control valve 40 is operable to reverse the direction of operation of the motor to enable the power tool 10 to be utilized to loosen the fastener assembly.

A bit rod 42 extending along the axis 56 of the tool through the tubular rotor 16 and tubular drive member 28 is engageable with the bolt of a fastener assembly while the socket is engageable with the nut of such assembly and operates to hold the bolt against rotation with the nut as the nut is either tightened or loosened on the bolt. The bit rod illustrated is formed with a hexagonal cross section which mates with a hexagonal recess formed in such bolt to prevent relative rotation therebetween during the operation of the wrench.

Figure 2:
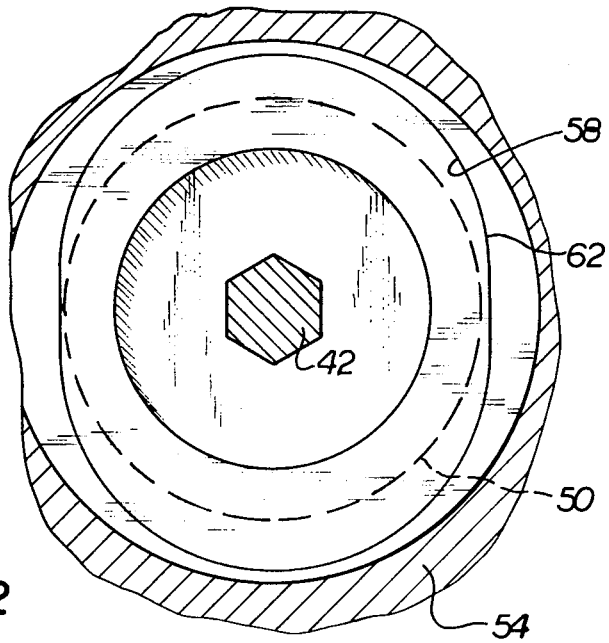
FIG. 2 is a fragmentary cross section taken generally along the line 2—2 of FIG. 1.
Figure 3:
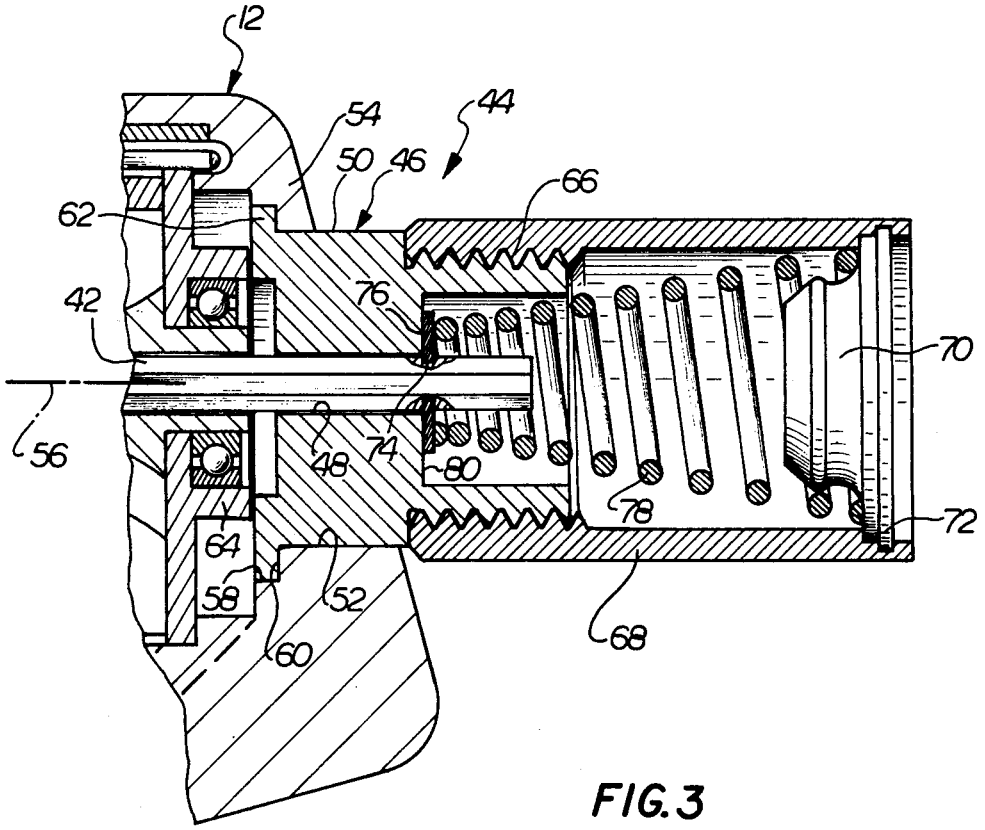
FIG. 3 is an enlarged, fragmentary section illustrating the structure of the adapter housing and its mounting on the wrench housing.

The bit rod 42 is held against rotation while being free for limited axial movement by an adapter assembly 44, best illustrated in FIG. 3. Such assembly includes an adapter ring 46 formed with a hexagonal opening 48 through which the rearward end of the bit rod 42 extends with a relatively close fit. The adapter ring 46 is formed with a cylindrical portion 50 which extends with a close fit through a bore 52 formed in the end portion 54 of the housing 12 aligned with the axis 56 of the tool. Inwardly of the bore 52, the end portion 54 is also formed with a recess or counterbore 58 providing a radially extending wall 60 which operates to locate the adapter ring 50 in one direction. In the illustrated embodiment, the recess 58 is generally oval in shape, as best illustrated in FIG. 2, and therefore provides surfaces which are axially extending but non-circular. The adapter housing is provided with a flange 62 which closely fits the recess 58, engaging the radial surface 60, and is provided with an oval shape which mates with the oval shape of the recess. Consequently, this flange axially locates the adapter ring 46 in one direction and prevents relative rotation between the adapter ring 46 and the housing 12. The flange in the illustrated embodiment also is axially located in the opposite direction by the close proximity with the bearing support 64, constituting part of the motor 14. It is preferred to provide such an internal structure to prevent rotation of the adapter ring, but it is within the broader aspects of this invention to provide external interfitting surfaces.

The outer end of the adapter ring 46 is formed with threads 66 adapted to mate with internal threads formed on a tubular spring housing 68. The outer end of the spring housing 68 is closed by a spring retainer 70 secured in position by a snap ring 72, which extends into the mating groove in the spring housing.

The rearward end of the bit rod 42 is formed with a groove 74 which receives a split ring 76, and is therefore locked on the bit rod against axial movement. A spring 78 extends between the spring retainer 70 and the split ring 76, and urges the split ring, and in turn the bit rod, to the left as viewed in FIG. 3 in an extending direction. The spring 78 normally maintains the bit rod in an extended position, with the split ring 76 against a radial wall 80 but allows the bit rod to move to the right toward a retracted position when it engages a bolt. Preferably, the forward end of the bit rod 42 extends a short distance beyond the end of the socket 24, as illustrated in FIG. 1, when the bit rod is in an extended position, so that the tool user can ensure proper engagement of the bit rod 42 with the mating recess in the end of the bolt before the tool is operated. If the tool is operated to tighten the nut on the bolt, the socket moves in a direction to the left during the tightening operation relative to the bolt, and in turn the bolt-engaging bit rod, and causes the bit rod to move relative to the tool to the right against the action of the spring 78. During the loosening operation, the opposite relative movements occur.

With the present invention, a standard power tool produced with the economies of relatively high production can be easily and economically modified or customized to provide it with bolt holding capability. The mounting of the adapter ring is accomplished by merely modifying the housing to provide the bore 52 and recess 58 in which the adapter ring is mounted. This simple modification of the housing structure does not require very great additional manufacturing costs. Similarly, if the drive member 28 or the motor rotor 16 is not tubular in the standard tool, such elements must be bored out or tubular elements substituted to provide the through passage along which the bit rod extends.

In the event that it is necessary to change the bit rod 42, the spring housing 68 is threaded off the adapter ring 46, allowing axial removal of the bit rod from the rearward end of the tool. Replacement of the bit rod is easily accomplished by inserting a replacement bit rod and reinstalling the spring and spring housing 68.

If it is desired to operate the wrench in the conventional way, without bolt holding capabilty, the spring housing 68 can be threaded off the adapter ring and the bit rod removed. A simple, shallow cap (not illustrated) can then be threaded onto the adapter ring to close the rearward end of the housing.

Although the preferred embodiment of this invention has been shown and described, it should be understood that various modifications and rearrangements of the parts may be resorted to without departing from the scope of the invention as disclosed and claimed herein.

What is claimed is:

1. An end drive power wrench comprising a wrench housing assembly, power means in said wrench housing assembly, including a motor, a tubular drive member journaled in said wrench housing assembly for rotation by said motor about an axis of rotation, said wrench housing assembly including an end portion located along said axis at the end thereof opposite said drive member, said end portion providing a cylindrical opening substantially coaxial with said axis of rotation and an internal recess adjacent said opening providing a radially extending surface, an adapter housing assembly mounted on said end portion including an adapter ring providing a cylindrical portion extending through said cylindrical opening with a close fit and a flange mating with said radially extending surface to lock said adapter ring against axial movement in at least a direction away from said drive member, said wrench housing assembly and said adapter assembly including mating axially extending surfaces operable to prevent rotation between said adapter ring and said wrench housing assembly, an elongated bit rod extending along said axis through said adapter ring and drive member, non-circular mating surfaces on said adapter housing and said bit rod preventing rotation of said bit rod relative to said adapter ring while allowing axial movement of said bit rod relative to said drive member, and spring means in said adapter housing assembly resiliently biasing said bit rod in an axial direction toward said drive member and allowing axial movement in the opposite direction, said drive member being operable to rotate a first threaded fastener while said bit rod engages a second threaded fastener and prevents rotation of said second threaded fastener while said drive member produces rotation of said first fastener.

2. A power wrench as set forth in claim 1, wherein said flange is engageable with an internal surface within said housing to lock said adapter ring against axial movement in a direction opposite to said one direction.

3. A power wrench as set forth in claim 1, wherein said recess and flange are oval in shape to prevent rotation of said adapter ring relative to said wrench housing.

4. A power wrench as set forth in claim 1, wherein said power wrench is substantially a standard production wrench modified to provide said cylindrical opening and said internal recess.

5. A power wrench as set forth in claim 1, wherein said bit rod has a hexagonal cross section, and said non-circular mating surfaces preventing rotation between said bit rod and adapter ring are hexagonal.

6. A power wrench as set forth in claim 5, wherein said bit rod provides a radial groove adjacent one end, a split snap ring is positioned with said radial groove, and said spring means is a wire spring engaged by said split snap ring, said split snap ring engaging a surface on said adapter ring to limit extending movement of said bit rod.

7. A power wrench as set forth in claim 1, wherein said bit rod is removable to convert said wrench for standard operation.

8. A power wrench as set forth in claim 1, wherein a spring housing is removably threaded onto said adapter ring and encloses the end of said bit rod and spring means.

9. A power wrench as set forth in claim 1, wherein said motor provides a tubular rotor along said axis and said bit rod extends through said rotor.

10. A modified power wrench comprising a substantially standard wrench, including a wrench housing assembly, a motor in said housing, a tubular drive member driven by said motor and journaled at one end of said housing for rotation about an axis, said wrench housing being modified to provide an opening along said axis at the end thereof remote from said drive member and an internal radially extending surface, an adapter housing assembly on said wrench housing including an adapter ring providing a portion extending through said opening and a flange engaging said radially extending surface preventing movement of said adapter ring in a direction away from said drive member, said adapter ring providing a projecting threaded portion extending beyond the end of said wrench housing, a spring housing threaded onto said threaded projecting portion, a bit rod extending along said axis through said tubular drive member and adapter ring, said adapter ring and bit rod providing non-circular mating surfaces preventing relative rotation therebetween while allowing axial movement of said bit rod, a mechanical spring in said housing resiliently urging said bit rod in a direction toward said drive member toward an extended position, said wrench housing assembly and said adapter housing assembly providing interfitting surfaces preventing rotation of said adapter ring relative to said wrench housing assembly and in turn relative rotation between said bit rod and said wrench housing assembly, said drive member being operable to rotate a first threaded fastener while said bit rod engages a second threaded fastener and prevents rotation thereof with said first threaded fastener.

11. A modified power wrench as set forth in claim 10, wherein said motor includes a tubular rotor journaled for rotation around said axis, and said bit rod extends through said tubular rotor.

12. A modified power wrench as set forth in claim 11, wherein said interfitting surfaces are located within said wrench housing adjacent to said radially extending surface.

13. A modified power wrench as set forth in claim 12, wherein said interfitting surfaces are provided by an oval-shaped recess within said wrench housing and a mating oval shape on said flange.

14. A modified power wrench as set forth in claim 10, wherein said interfitting surfaces are axially extending surfaces spaced from said axis.

* * * * *